FIP8011 OR 4,006,777

United States Patent [19]

LaBauve

[11] 4,006,777

[45] Feb. 8, 1977

[54] FREE FLOATING CARRIER FOR DEEP WELL INSTRUMENTS

[76] Inventor: Leo C. LaBauve, 1506 Center St., New Iberia, La. 70560

[22] Filed: Feb. 6, 1976

[21] Appl. No.: 655,687

[52] U.S. Cl. ..... 166/250; 166/169; 175/309

[51] Int. Cl.[2] ..... E21B 47/00

[58] Field of Search ..... 166/64, 154, 156, 162, 166/169, 250; 175/309

[56] References Cited

UNITED STATES PATENTS

| | | | |
|---|---|---|---|
| 1,812,943 | 7/1931 | Granger | 166/250 UX |
| 2,190,901 | 2/1940 | Wilcox et al. | 166/169 |
| 2,776,564 | 1/1957 | Montgomery et al. | 166/64 X |
| 2,927,641 | 3/1960 | Buck | 166/64 |
| 2,970,547 | 2/1961 | McMurry | 166/64 X |

*Primary Examiner*—Stephen J. Novosad
*Assistant Examiner*—George A. Suchfield
*Attorney, Agent, or Firm*—William P. Green

[57] ABSTRACT

A carrier and contained well instrument which are light enough to float in the fluid in a well are forced downwardly in the well to a predetermined test zone by downward movement of the fluid. After performance of a testing operation by the instrument, the buoyant carrier and instrument are permitted to float upwardly within the fluid to the surface of the earth for retrieval.

13 Claims, 7 Drawing Figures

FREE FLOATING CARRIER FOR DEEP WELL INSTRUMENTS

BACKGROUND OF THE INVENTION

This invention comprises a free floating carrier for deep well instruments and more generally pertains to a system for conveying deep well testing and recording instruments in a well bore to a selected region to be tested, obtaining test data by said instruments and then returning the instruments to the surface through the well bore for retrieving the test data obtained thereby, all in an automatic manner controlled from the surface.

It is frequently desirable to obtain precise test data as to conditions in selected regions in a well bore by conveying testing and/or recording instruments through the well bore to the selected region, conducting the test and recording the test data, and then returning the instruments to the surface where the data may be retrieved and used in various manners. Heretofore, it has been necessary to transport instruments in a well bore through the agency of wire lines, or attaching the instruments to rod or pipe strings or the like. Such methods have been unwieldy and cumbersome, requiring the use of or manipulation of relatively long mechanical instrument supporting and handling lines or strings, and have been relatively time consuming while also in some instances detrimentally affecting the condition of the well bore by the movement of the instruments through the fluid in the well bore.

Under the conventional method of introducing and withdrawing instruments from a well bore by the use of wire lines, it is necessary to discontinue the mud circulation in the hole for varying periods of time, as for example, thirty minutes to an hour or more. This results in a diminution of the protective mud pressure against the walls of the well bore, producing a dangerous or hazardous condition. Further, during the wire line manipulation of the instruments, the well head is necessarily open, for the wire line to work through, preventing the application of pressure from the pump or the maintenance of pressure in the well bore as a precaution against blow outs from high pressure zones while the instruments are being employed.

SUMMARY OF THE INVENTION

An important object of the invention is to overcome the above disadvantages of prior practice and provide means which will require the interruption of the mud circulation, and the opening of the pressurized system from the pump through the swivel and pulley and to the bit, for only a few seconds as the instruments and their carrier are introduced into or withdrawn from the well bore.

A primary purpose of the invention is to provide a greatly improved system and means for effecting the controlled conveying of such instruments to and from a selected region to be tested.

A further more specific object of the invention is to provide a system whereby the instruments to be conveyed may be transported to and from the selected region without requiring mechanical connection of the instrument carrier to the surface, and further and more specifically by utilizing such existing facilities as the selective production of or stopping of a flow of fluid in a fluid column from the surface to the region to be tested.

Another specific object of the invention is to provide a method and an instrument carrier whereby the instruments may be transported to and from the selected region by the selective movement of fluid downwardly to the region and by the effective bouyancy of the instrument carrier in the fluid after cessation of the downward fluid flow in order to enable the carrier to return to the surface.

An additional object of the invention is to provide a carrier of a buoyant nature which may consist of a plurality of axially aligned separable sections whose assembly may be varied to adjust the overall buoyancy of the device, and its instrument carrying capacity.

Another purpose of the invention is to provide a device in accordance with the foregoing objects which will include resilient guide means for centralizing and stabilizing the carrier within a well bore during its travel therein.

A final important object of the invention to be specifically enumerated herein resides in the provision of a carrier in accordance with the preceding objects containing a chamber movably receiving a receptacle in which is housed the various instruments for testing and recording purposes, together with means for providing a shock cushioning of the receptacle within the chamber.

BRIEF DESCRIPTION OF THE DRAWINGS

These together with other objects and advantages of the invention will be better understood from the following detailed description of the typical embodiment illustrated in the accompanying drawings, in which.

DESCRIPTION OF THE PREFERRED EMBODIMENT

Figure 1:
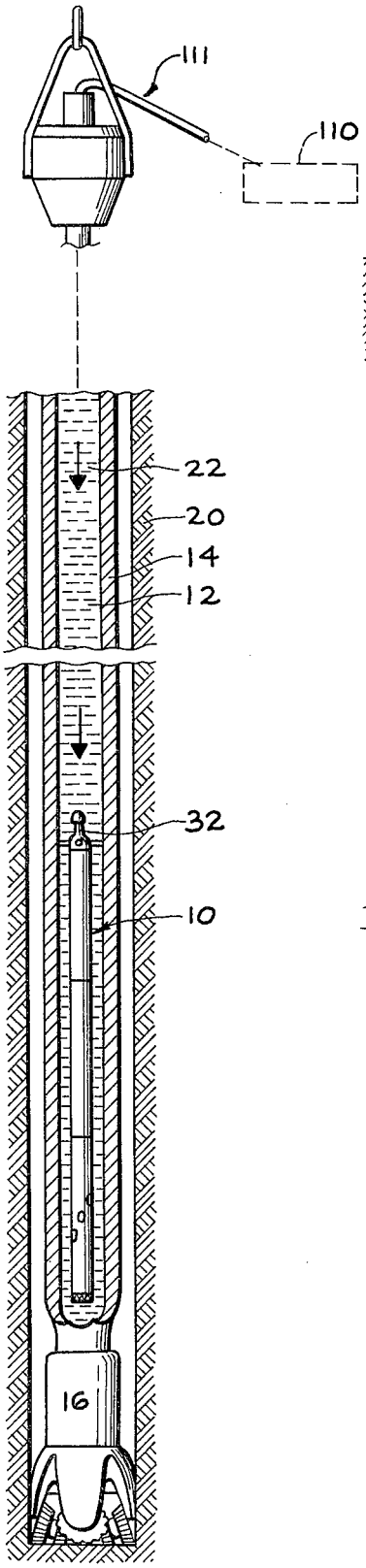
FIG. 1 is a fragmentary view in vertical section through a portion of a well bore and a contained pipe string (such as a drill string), and showing the novel instrument carrier of the invention after being forced downwardly in the pipe string by downward fluid flow to a position adjacent the region to be tested.
Figure 2:
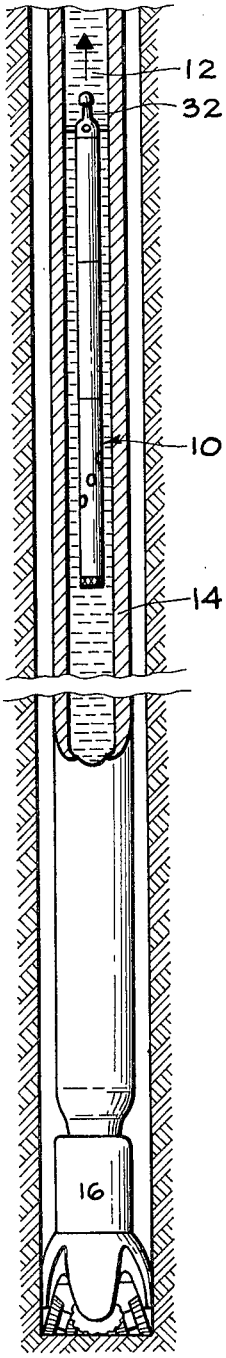
FIG. 2 is a view similar to FIG. 1 but showing the position of the buoyant instrument carrier after it has floated upwardly to a location near the surface of the earth upon cessation of the fluid flow downwardly through the pipe.
Figure 3:
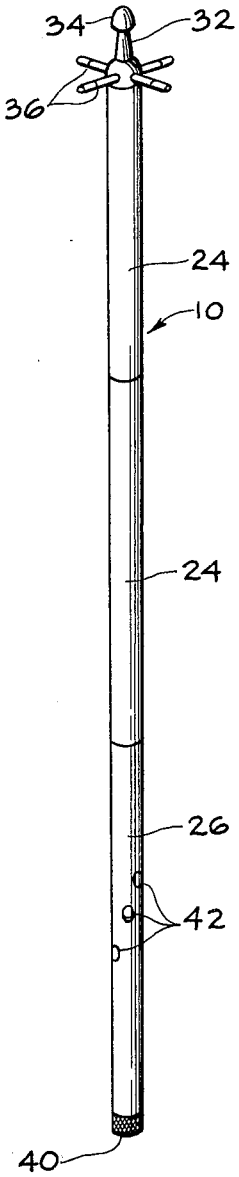
FIG. 3 is a perspective view of the instrument carrier constructed in accordance with the invention.

Referring first to FIGS. 1 and 2 it will be observed that a novel instrument carrier constructed in accordance with the invention is indicated generally in those figures by the numeral 10, this instrument being shown in a column of fluid 12 confined within a column maintaining means such as a pipe string 14, which may constitute a drilling string having a conventional drilling bit 16 at its lower end. It will be appreciated that the pipe string 14 is, for the purpose of this invention, any suitable means for confining and maintaining a column of the fluid within a well bore 20 which extends to any suitable region which it is desired to test by various instruments. It is also to be understood that the pipe string has connected thereto any suitable source of pressurized fluid for producing a flow of fluid under pressure downwardly in the pipe string as indicated by the arrow 22, which source may constitute the usual drilling fluid circulating pump represented diagrammatically at 110 in FIG. 1, acting to pump drilling mud under pressure into the upper end of the string through the usual swivel 111. Further, the pipe string is understood to have some access means at the surface of the earth by means of which carrier 10 may be introduced into or removed from the string from time to time as may be desired without the necessity for removing the pipe string from the well bore.

Figure 4:
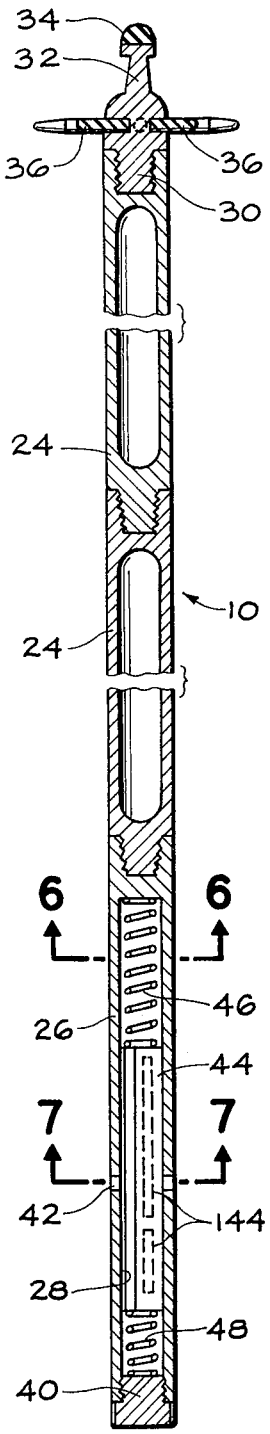
FIG. 4 is an enlarged vertical longitudinal section through the instrument carrier of FIG. 3.
Figure 5:
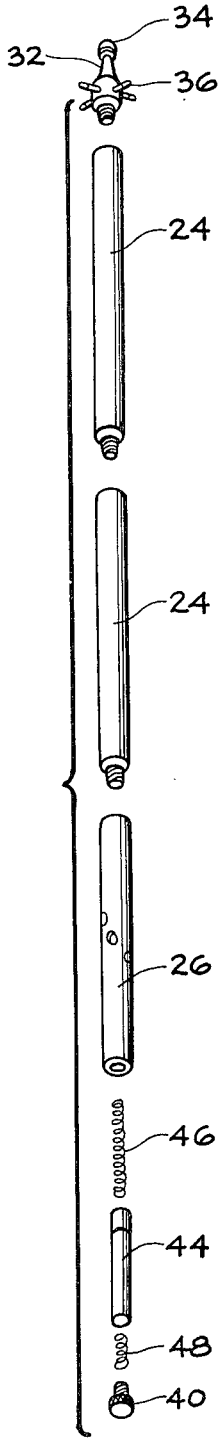
FIG. 5 is an exploded perspective view of the instrument carrier of FIG. 4.
Figure 6:
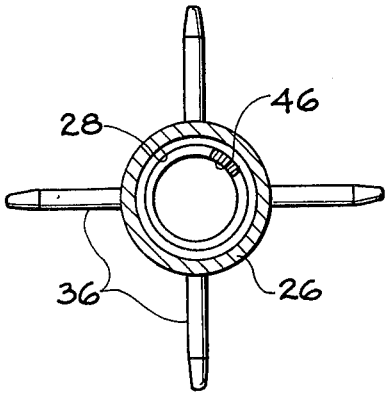
FIGS. 6 and 7 are enlarged horizontal sections taken on lines 6—6 and 7—7 respectively of FIG. 4, through the chamber of the instrument carrying section of the device.
Figure 7:
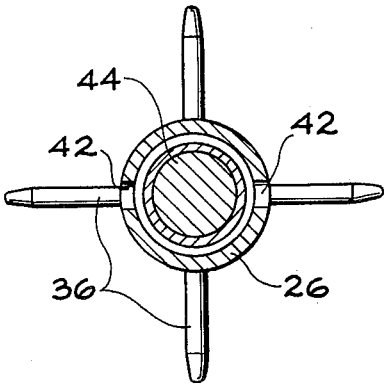

Carrier 10 (see in particular FIGS. 4 and 5) comprises a hollow rod-like body which may conveniently consist of a plurality of axially and detachably aligned and connected sections, such as a plurality of hollow, sealed buoyancy producing sections 24 and an instrument carrying section 26 having a chamber 28 therein. Any desired number of these sections may be joined together in end-to-end alignment in varying numbers and arrangements to form a body having any desired buoyancy and instrument carrying capacity as required by the particular operations to be performed. In lieu of the hollow sections 24, the carrier buoyancy components may be formed of a suitable light solid material which is inherently of sufficiently low density to float upwardly within the circulating fluid, and which material may have pressure equalizing bores drilled therethrough or therein if desired.

At its upper end, the uppermost section 24 has detachably secured thereto the threaded lower extremity 30 of a coupling member 32 which may have an enlarged head 34 by means of which a wire line grapple or other means may be detachably engaged with the carrier to lift and handle the same or introduce it into or remove it from the pipe string at the surface. Further, the connector 32 is provided with a plurality of laterally projecting and preferably radially extending guide arms 36, of a resilient material such as rubber or the like, which serve to resiliently engage the sides of the pipe string 14 or other fluid column confining means to center and guide the carrier 10 during its travel in the pipe string.

The instrument containing section 26 is preferably provided with an open end which is closed by a removable closure plug 40. This section may conveniently be provided with ports 42 in its side walls by means of which a free and continuous communication is established between the chamber 28 and the pipe string or other fluid column maintaining means for testing purposes.

Loosely and slidably received in the chamber 28 is a receptacle 44 preferably of a cylindrical shape in which are disposed one or more instruments 144 for testing and test recordation. This receptacle is resiliently mounted in chamber 28 by shock absorbing and cushioning means, which may consist of a pair of springs 46 and 48 interposed respectively between the opposite ends of receptacle 44 and the corresponding ends of chamber 28, to yieldingly support the receptacle and instruments in an intermediate position while protecting them against shock.

The operation of the apparatus and the method of obtaining test data from deep well regions in accordance with this invention will now be readily understood as follows:

The desired numbers of different types of sections 24 and 26 are made up into the complete carrier 10, with section 26 receiving the receptacle 44 therein containing the necessary testing and recording instruments. It will be appreciated that a number of these sections 26 may be assembled into a single carrier 10 as may be desired or necessary.

With the proper number of the buoyant sections 24 assembled into the carrier, the latter is lifted by any suitable means, such as a wire line or the like engaging the head 34 of the coupling member 32, and is disposed in the upper end of the pipe string 14 at the surface in any suitable manner, not shown but well understood by those skilled in the art. When the carrier is inserted in the fluid column maintained in the pipe string, it will buoyantly float at the upper end thereof, since the effective average density of the carrier and its contents is less than the density of the drilling mud or other fluid within the string. When it is desired to conduct the test, a fluid flow producing means such as the mud pump 110 of FIG. 1 is started, thereby producing a flow of the fluid in the column downwardly through the pipe string and to the region to be tested. This downward flow will transport the carrier 10 therewith and the carrier will be maintained at the desired region as long as this flow continues. The desired region may be in the area of the drill bit 16, in which event the carrier will rest against or adjacent the end of the drill bit during the fluid flow. On the other hand, if the region to be tested is spaced above the drill bit, the pipe string has suitable stop means disposed therein for halting the carrier at the location.

The carrier is maintained at the desired region for a sufficient period of time to enable the instruments therein to make the necessary tests and to obtain the desired test data. The operation of the instruments may be effected in any desired manner, which in itself forms no part of the present invention.

After the testing has been completed and the desired records made as a result thereof, the carrier and the instruments are retrieved to the surface by merely stopping the flow producing means such as pump 110. Upon cessation of the downward fluid flow, the natural buoyancy of the carrier will cause it to float upwardly through the fluid to the surface, where it may then be removed by the handling or grappling means previously mentioned and the test instruments and/or test data recovered therefrom.

There is thus provided a means and a system whereby test operations may be performed and test data recovered from a deep well region by the use of existing pipe strings and without the necessity for introducing any additional equipment and merely through the utilization of the conventional flow producing means of a pipe string.

The foregoing is considered as illustrative only of the principles of the invention. Since numerous modifications and changes will readily occur to those skilled in the art, it is not desired to limit the invention to the exact construction and operation shown and described, and accordingly all suitable modifications and equivalents may be resorted to, falling within the scope of the invention as claimed.

What is claimed as new is as follows:

1. Apparatus for conveying deep well instruments into and out of a well bore, comprising:

means for maintaining a column of fluid extending downwardly in the well bore to a region at which a test is to be made;

means operable to controllably produce a flow of fluid downwardly through said column to said region and to halt said flow as desired; and a carrier in said fluid column for holding an instrument or instruments adapted to test and/or obtain test records of said region, said carrier and its contents being movable downwardly by the flow of fluid in said column to said region and being sufficiently buoyant to float to the surface in said fluid column when fluid flow downwardly therethrough ceases.

2. Apparatus as recited in claim 1, including a test instrument carried by said carrier and having a combined effective density with said carrier to be forced downwardly with the carrier by movement of the fluid and to float upwardly within the fluid upon termination of the fluid flow.

3. An instrument carrier for use in testing a region in a well which includes a pipe string extending from the surface to said region, and means for maintaining a column of fluid in said pipe string and for selectively producing and stopping a flow of fluid downwardly in said pipe string to said region, said instrument carrier comprising:

a hollow body containing a chamber for housing an instrument for testing and/or making test records of said region;

said body being capable of being conveyed by said fluid flow downwardly in said pipe string to said region and being sufficiently buoyant to float upwardly through said pipe string to the surface upon stoppage of said fluid flow.

4. An instrument carrier as recited in claim 3, in which said carrier body has a wall containing a passage or passages placing said chamber in communication with the fluid in said pipe string for testing of said region by an instrument housed within said body.

5. An instrument carrier as recited in claim 4, in which said body comprises a plurality of separably axially aligned and connected sections, one of said sections containing said chamber.

6. An instrument carrier as recited in claim 5, including a receptacle movably received within said chamber for containing said instrument, and shock cushioning means in said chamber resiliently supporting said receptacle.

7. An instrument carrier as recited in claim 6, in which cushioning means include springs disposed between and engaging opposite ends of said chamber and receptacle.

8. An instrument carrier as recited in claim 3, in which said body includes a first section containing said chamber and having a wall containing a passage placing said chamber in communication with the fluid in said pipe string for testing of said region by an instrument housed within said chamber, said body including a second section connected in end-to-end alignment with said first section and constituting a buoyancy means for said body.

9. An instrument carrier as recited in claim 3, in which said body includes a plurality of separably axially aligned and connected sections, one of said sections containing said chamber.

10. An instrument carrier as recited in claim 3, in which said body includes a plurality of separably axially aligned and connected sections, one of said sections containing said chamber, there being means on one of said body sections and projecting laterally therefrom for resiliently centering said body in said fluid column.

11. The combination comprising an instrument carrier as recited in claim 3, and a test instrument or instruments contained in said chamber and having a combined effective density with the carrier to be forced downwardly therewith by fluid flow and float upwardly upon cessation of the fluid flow.

12. The method of testing a subsurface region in a well containing a column of fluid, said method comprising:

introducing into the fluid column a test unit having an effective overall density to be buoyant in said fluid;

producing a flow of fluid downwardly in the well at a velocity conveying said test unit downwardly with the fluid to said region;

conducting a test by said unit while the unit is at said region; and allowing said unit to float upwardly by its buoyancy through said fluid column and to the surface of the earth.

13. The method as recited in claim 12, including retrieving a test record from said unit after it has returned to the surface.

* * * * *